United States Patent [19]

Kondo et al.

[11] 4,315,231

[45] Feb. 9, 1982

[54] HIGH-SPEED CIRCUIT BREAKER

[75] Inventors: Hisashi Kondo; Shozo Yamazaki; Yukio Yamada, all of Katsuta, Japan

[73] Assignee: Hitachi, Limited, Tokyo, Japan

[21] Appl. No.: 214,695

[22] Filed: Dec. 9, 1980

[30] Foreign Application Priority Data

Dec. 10, 1979 [JP] Japan ..... 54/159150

[51] Int. Cl.[3] ..... H01H 7/03

[52] U.S. Cl. ..... 335/61; 335/63

[58] Field of Search ..... 335/29, 59, 61, 62, 335/63, 64

[56] References Cited

U.S. PATENT DOCUMENTS

| | | | |
|---|---|---|---|
| 3,254,177 | 5/1966 | Gottsacker et al. | 335/61 X |
| 3,509,501 | 4/1970 | Brovedan | 335/61 |
| 4,104,602 | 8/1978 | Fujita et al. | 335/61 |

OTHER PUBLICATIONS

Japanese Patent Laid-Open No. 92558/74.

*Primary Examiner*—George Harris

*Attorney, Agent, or Firm*—Craig and Antonelli

[57] ABSTRACT

High-speed breaker for an electric circuit, including a fixed contact, movable contact and a movable holder for the movable contact. An actuating rod is reciprocally movable toward and away from the fixed contact between first and second positions. A head is connected to the actuating rod. In the first position of the actuating rod, the head engages with the movable holder to cause the movable contact to engage with the fixed contact. In the second position of the actuating rod, the movable contact is disengaged from the fixed contact. A release member connected to the head is operative in response to overcurrent passing through the circuit when the actuating rod is in the first position, to disengage the movable holder from the head to disengage the movable contact from the fixed contact. An extension of the actuating rod is located between the engaging position of the movable holder with the head and the connecting position of the release member to the head.

8 Claims, 8 Drawing Figures

HIGH-SPEED CIRCUIT BREAKER

BACKGROUND OF THE INVENTION

This invention relates to high-speed circuit breakers, and more particularly it is concerned with improvements in or relating to a high-speed circuit breaker of the type disclosed in Japanese Patent Laid-Open No. 92558/74.

A high-speed circuit breaker of the prior art disclosed in Japanese Patent Laid-Open No. 92558/74 comprises a pair of opposed contacts and a movable holder for supporting one of the pair of contacts. The movable holder is movable toward and away from the other contact between an ON position in which the pair of contacts are brought into engagement with each other and an OFF position in which they are disengaged from each other. A first actuator comprises a cylinder, a piston slidably received in the cylinder, an actuating rod having one end connected to the piston and the other end which is free, and a head substantially in the form of a letter L having two legs. The actuating rod is connected at the other end thereof to the end of one leg of the L-shaped head. The actuating rod is reciprocally movable axially thereof by the piston toward and away from the other contact between a first position in which the head engages the movable holder to move the latter to its ON position and a second position in which the head is disengaged from the movable holder to allow the latter to move to its OFF position.

The movable holder includes a lever having one end supporting the one contact and the other end pivotally connected to the other leg of the L-shaped head, and a pivot member having an axis extending at an angle with respect to the axis of the actuating rod including one end pivotally connected to the other end of the lever and the other end which is free. Connected to the other end of the pivot member is a pin having a roller rotatably mounted thereon and adapted to engage a supporting surface formed on the one leg of the L-shaped head. The movable head is urged by the biasing force of a release spring to move in a direction in which the lever pivotally moves about the other end thereof from the ON position toward the OFF position.

A release member has one end pivotally connected to the other leg of the L-shaped head and the other end which is free and formed with a recess and is movable between an engaging position in which the recess engages the projecting end of the pin connected to the free end of the pivot member and a disengaging position in which the recess is disengaged from the pin. A second actuator is operative, in response to an overcurrent passing through the circuit when the actuating rod of the first actuator is in the first position, to move the release member to the disengaging position to disengage the roller from the supporting surface of the one leg of the L-shaped head, to thereby allow the movable holder to be moved from the ON position to the OFF position by the biasing force of the release spring.

When the movable holder moves from the ON position to the OFF position, it is brought into abutment with a fixed abutment member, so that its movement is restricted or limited thereby.

The position in which the roller mounted at the other end of the pivot member engages the supporting surface on the one leg of the L-shaped head when the actuating rod of the first actuator is disposed in the first position and the release member is in the engaging position is located between an extension of the actuating rod and the position in which the other end of the lever is pivotally connected to the other leg of the L-shaped head. A force acting on the piston is transmitted through the actuating rod, L-shaped head, roller, pivot member and lever to the one contact, to force same against the other contact. The reaction applied by the other contact to the one contact produces a moment in the lever turning the lever in one direction about the pivot at which the pivot member is pivotally connected to the lever. Since the lever is pivotally connected to the L-shaped head, the moment acting on the lever is transmitted through the L-shaped head to the actuating rod, subjecting the actuating rod to a moment oriented in one direction. The moment oriented in one direction acting on the actuating rod tends to cause unbalanced wear on the actuating rod and the wall surface of a guide bore formed in the cylinder, giving rise to fretting corrosion.

When the actuating rod of the first actuator is in the second position and when the actuating rod is in the first position and the release member is in the disengaging position, the movable holder is urged by the biasing force of the release spring to abut against the abutment member. The lever of the movable holder is subjected to the reaction from the abutment member commensurate with the biasing force of the release spring which reaction produces in the lever a moment which tends to turn the lever in the opposite direction about the pivot at which the lever is pivotally connected to the L-shaped head. The moment acting on the lever is transmitted through the L-shaped head to the actuating rod which is subjected to a moment oriented in the opposite direction. The moment oriented in the opposite direction acting on the actuating rod tends to cause unbalanced wear on the actuating rod and the wall surface of the guide bore formed in the cylinder, giving rise to fretting corrosion.

Also while the circuit breaker is in operation, the actuating rod moves in angular movement because it is repeatedly subjected to moments oriented in opposite directions, and the sliding movement taking place between the pair of contacts increases in amount. This gives rise to the problem of misalignment of the pair of contacts.

The release spring would have the direction of its arrangement limited in such a manner that the biasing force thereof minimizes the moment oriented in the opposite direction.

An object of the invention is to provide a high-speed circuit breaker capable of minimizing the moment acting on the actuating rod of the first actuator at least when the actuating rod is in the first position and the release member is in the engaging position.

Another object is to provide a high-speed circuit breaker capable of minimizing the moment acting on the actuating rod in all operating conditions.

The first object of the invention can be accomplished by an arrangement that an extension of the axis of the actuating rod of the first actuator is disposed between the position in which the movable head engages the head and the position in which the release member is connected to the head.

The second object of the invention can be accomplished by an arrangement that an extension of the axis of the actuating rod of the first actuator is disposed between the position in which the movable holder engages the head and the position in which the release member is connected to the head and the lever of the movable holder is connected to a stationary frame.

The present invention will now be described, by way of an example, with reference to the accompanying drawings, in which.

Figure 5A:
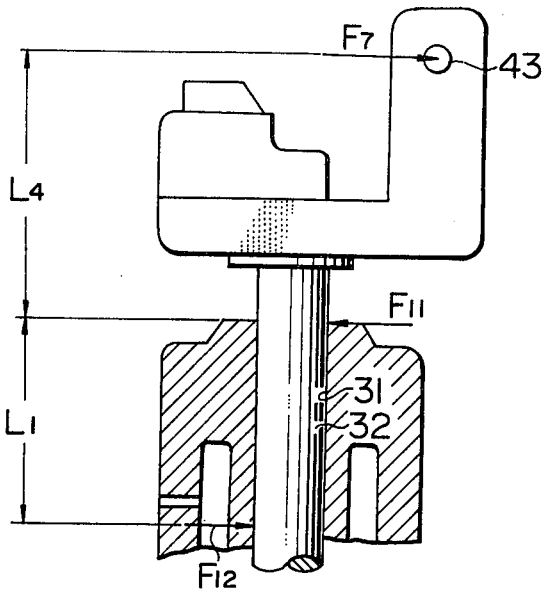
Figure 5B:
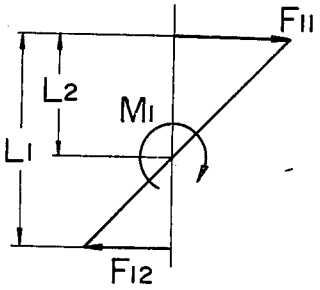
Figure 6A:
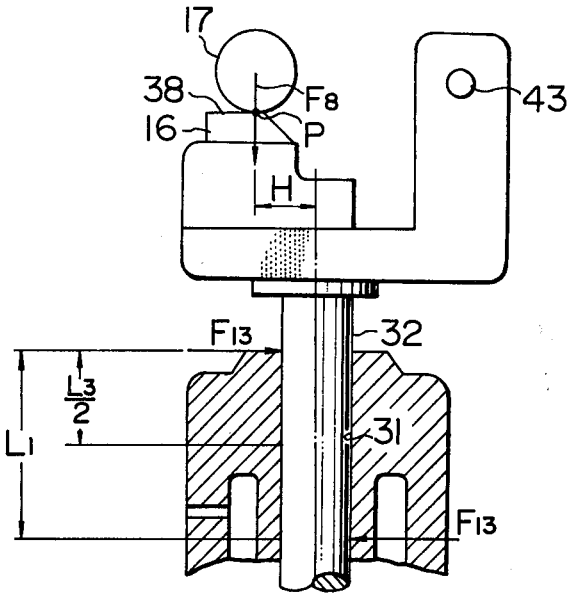
Figure 6B:
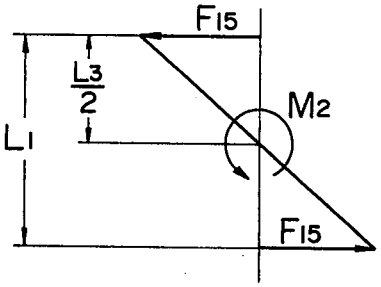

FIGS. 5*a* and 5*b* show a moment applied to the actuating rod when a transversely directed force is borne by the actuating rod guide opening; and FIGS. 6*a* and 6*b* show a moment produced by the displacement of the position in which the roller engages the head from the axis of the actuating rod and acting on the wall surface of the actuating rod guide bore.

Figure 1:
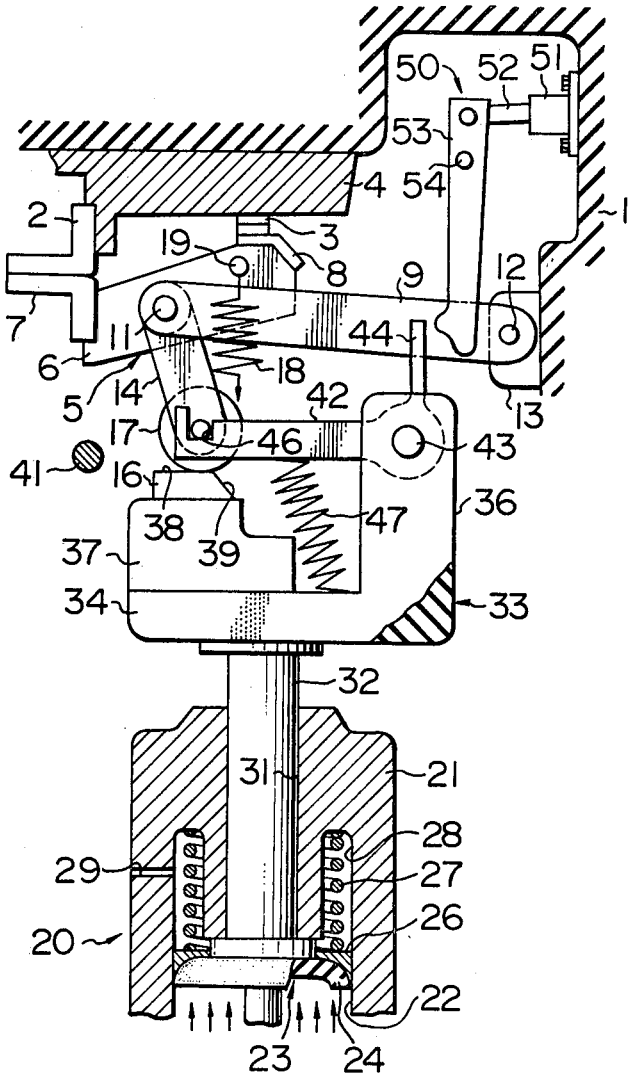
FIG. 1 is a schematic front view, with certain parts being shown in section, of the high-speed circuit breaker comprising one embodiment of the invention, showing the breaker in the ON position in which the actuating rod is in the first or extended position and the release member is in the engaging position.

Referring to FIG. 1, the high-speed breaker of an electric circuit according to the invention comprises a stationary frame 1 formed of an insulating material. A fixed contact including two contact elements 2 and 3 is attached to a conductor 4 mounted on the stationary frame 1. A movable contact includes two contact elements 7 and 8 juxtaposed against the two contact elements 2 and 3 of the fixed contact, respectively. A movable holder 5 supporting the movable contact includes a holder body 6 supporting the contact elements 7 and 8, and a lever arm 9 having one end pivotally connected at a pivot 11 to the holder body 6 and the other end pivotally connected at a pivot 12 to a bracket 13 secured to the stationary frame 1. The movable holder 5 further includes a pivot member 14 having one end pivotally connected at the pivot 11 to the holder body 6 and the other end which is free. A pin 16 is attached to the other end of the pivotal member 14 for supporting a roller 17 for rotation. The movable holder 5 is movable in directions in which it moves toward and away from the fixed contact elements 2 and 3 between an ON position shown in FIG. 1 in which the movable contact elements 7 and 8 are brought into engagement with the fixed contact elements 2 and 3, respectively and an OFF position shown in FIGS. 2 and 3 in which the movable contact elements 7 and 8 are disengaged from the fixed contact elements 2 and 3, respectively.

A release spring 18 having one end connected to a pin 19 attached to the holder body 6 of the movable holder 5 and the other end, not shown, connected to the stationary frame 1 urges by its biasing force the movable holder 5 to move from the ON position toward the OFF position.

Figure 3:
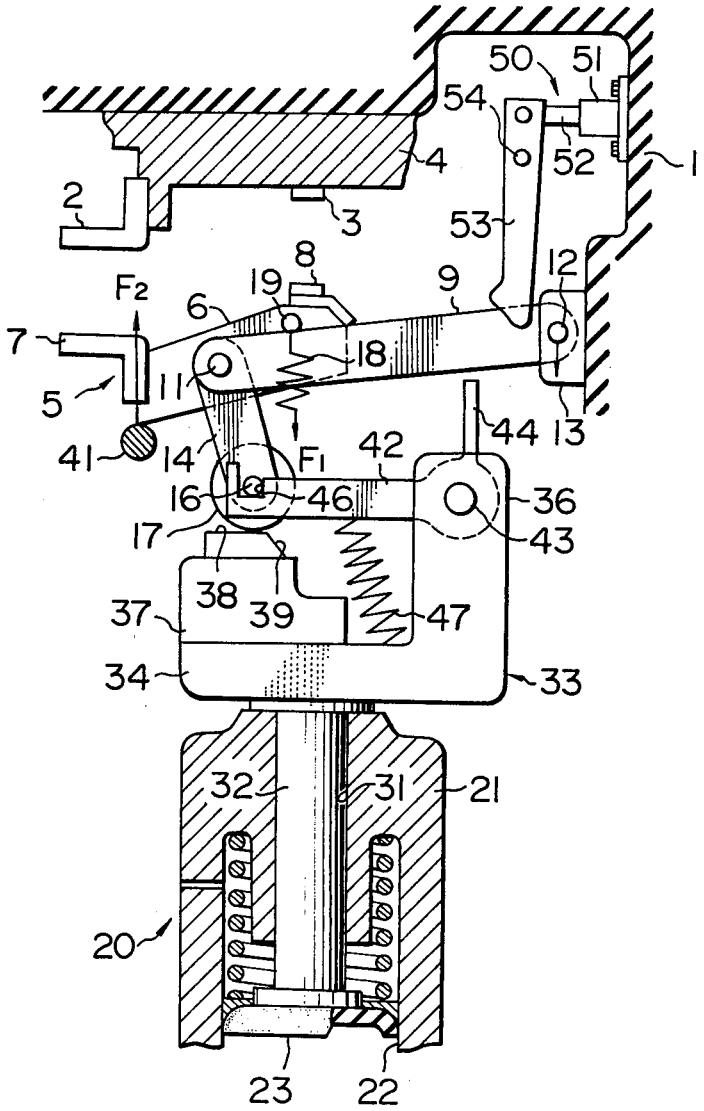
FIG. 3 is a view similar to FIG. 1 but showing the breaker in the OFF position in which the actuating rod is in the first or extended position and the release member is in the disengaging position.

A first actuator 20 includes a cylinder block 21, and a piston 23 slidably received in a cylinder bore 22. The piston 23 has a resilient seal member 24 and a retainer 26 backing up the seal member 24. The retainer 26 supports a spring 27 arranged concentrically with the cylinder bore 22 and disposed in an annular space 28 in the cylinder 21 which is maintained in communication with the atmosphere through a radial duct 29. The first actuator 20 further includes an actuating rod 32 extending through a guide bore 31 formed in the cylinder 21 and having one end secured to the piston 23 and the other end which is free. A head 33 formed of an insulating material substantially in the form of a letter L has two legs 34 and 36, one leg 34 being secured to the other end of the actuating rod 32. A supporting block 37 is mounted on the one leg 34 of the L-shaped head 33 and has a supporting top including a horizontal supporting surface section 38 and an inclined supporting surface section 39. The roller 17 supported at the other end of the pivot member 14 is capable of engaging the supporting top of the supporting block 37. The actuating rod 32 is moved in reciprocatory movement in the guide bore 31 by the pressure of fluid applied to the piston 23 in directions toward and away from the fixed contact elements 2 and 3 between a first or extending position shown in FIG. 1 and a second or retracted position shown in FIG. 3. When the actuating rod 32 is in the first position shown in FIG. 1, the horizontal supporting surface section 38 of the supporting block 37 on the L-shaped head 33 is brought into engagement with the roller 17, to move the movable holder 5 to the ON position against the biasing force of the release spring 18. When the actuating rod 32 is in the second position shown in FIG. 3, the horizontal supporting surface section 38 is disengaged from the roller 17, so that the movable holder 5 is moved by the biasing force of the release spring 18 to the OFF position. With the actuating rod 32 in the second position as shown in FIG. 3, the holder body 6 of the movable holder 5 is brought into abutting engagement with an abutment member 41 secured to the stationary frame 1, to thereby restrict or limit the movement of the movable holder 5.

A release member 42 has one end pivotally connected to the other leg 36 of the L-shaped head 33 at a pivot 43 and the other end which is free. A projection 44 is formed at the one end of the release member 42, and a recess 46 of the rectangular cross-sectional shape is formed at the other end of the release member 42. The pin 16 attached to the other end of the pivot member 14 of the movable holder 5 is engageable in the recess 46. A spring 47 has one end connected to the release member 42 and the other end connected to the one leg 34 of the L-shaped head 33 and urges the release member 42 by its biasing force to move about the pivot clockwise in FIG. 1 in a direction in which the recess 46 is brought into engagement with the pin 16. Thus the release member 42 is pivotally movable about the pivot 43 between an engaging position shown in FIGS. 1 and 3 in which the recess 46 engages the pin 16 and a disengaging position shown in FIG. 2 in which the recess 46 is disengaged from the pin 16.

A second actuator 50 includes a solenoid 51 bolted to the stationary frame 1, an actuating rod 52 adapted to be retracted and extended as the solenoid 51 is energized or de-energized, and a lever 53 pivotally connected to the stationary frame 1 at a pivot 54 having one end pivotally connected to a free end of the actuating rod 52 and the other end which is free and capable of engaging the projection 44 of the release member 42. The solenoid 51 is energized in response to an overcurrent passing through the electric circuit to retract the actuating rod 52 to angularly rotate the lever 53 clockwise in FIG. 1 about the pivot 54 to bring the free end of the lever 53 into engagement with the projection 44, to thereby move the release member 42 from the engaging position to the disengaging position.

It is to be noted that when the circuit breaker is in the ON position as shown in FIG. 1 an extension of the actuating rod 32 of the first actuator 20 is interposed between the position in which the roller 17 of the movable lever 5 is in engagement with the horizontal supporting surface section 38 of the L-shaped head 33 and the pivot 43 at which the one end of the release member 42 is pivotally connected to the other leg 36 of the L-shaped head 33.

In operation, upon introduction of a fluid pressure into the cylinder bore 22 of the first actuator 20, the actuating rod 32 is moved by the piston 23 to the first or extended position shown in FIG. 1. The L-shaped head 33 is moved toward the fixed contact elements 2 and 3 and the horizontal supporting surface section 38 of the supporting block 37 engages the roller 17 to move the movable holder 5 to the ON position shown in FIG. 1 against the biasing force of the release spring 18, to thereby bring the movable contact elements 7 and 8 into engagement with the fixed contact elements 2 and 3, respectively. This allows a current to pass through the electric circuit.

Figure 2:
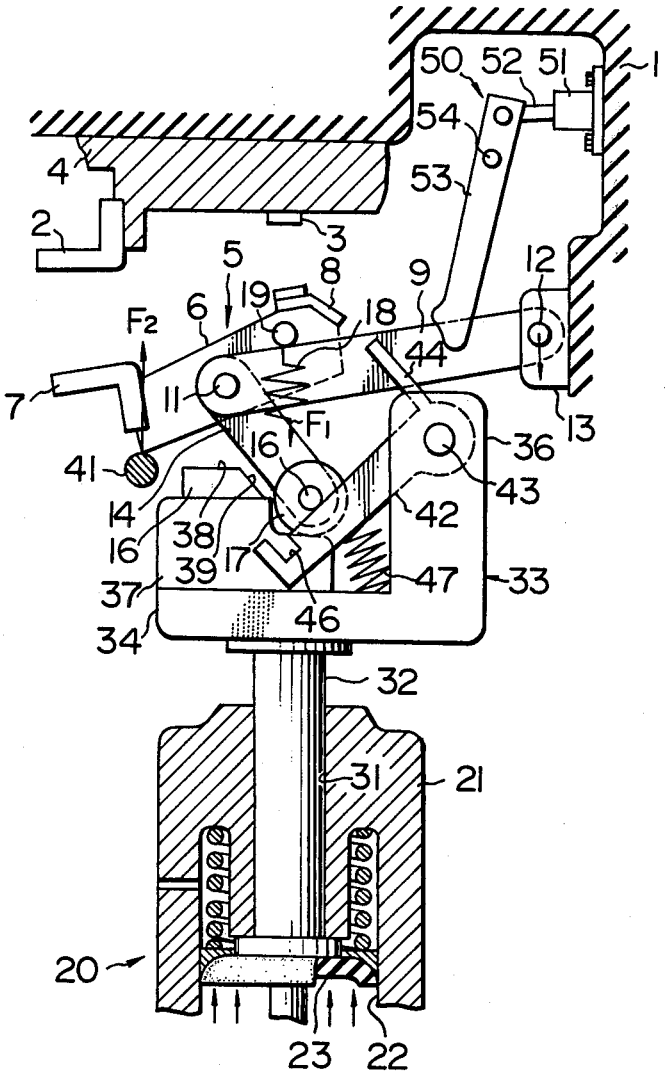
FIG. 2 is a view similar to FIG. 1 but showing forces acting on various members when the breaker is in the position shown in FIG. 1.

When an overcurrent passes through the electric circuit with the actuating rod 32 of the first actuator 20 in the first or extended position and the movable holder 5 in the ON position shown in FIG. 1, the solenoid 51 of the second actuator 50 is energized in response to the overcurrent and causes the actuating rod 52 to be retracted as shown in FIG. 2, so that the lever 53 is moved clockwise about the pivot 54 and the free end of the lever 53 engages the projection 44 of the release member 42 to move the release member 42 in pivotal movement about the pivot 43. The clockwise pivotal movement of the release lever 42 disengages the recess 46 from the pin 16. Since the movable holder 5 is under the influence of the biasing force of the release spring 18 and the axis of the pivot member 14 is inclined, disengagement of the recess 46 from the pin 16 allows the roller 17 to move in rolling movement on the horizontal supporting surface section 38 and inclined supporting surface section 39, so that the movable holder 5 is moved by the biasing force of the release spring 18 to the OFF position shown in FIG. 2 in which it abuts against the abutment member 41. Thus the movable contact elements 7 and 8 are disengaged from the fixed contact elements 2 and 3 respectively, thereby quickly opening the circuit. When the movable holder 5 is in the OFF position shown in FIG. 2, the pin 16 supported at the end of the pivot member 14 of the movable holder 5 engages a side edge of the release member 42 to thereby prevent the release member 42 from pivoting about the pivot 43 under the influence of the biasing force of the spring 47.

As the fluid pressure in the cylinder bore 22 of the first actuator 20 is released therefrom, the actuating rod 32 is moved away from the fixed contact elements 2 and 3 toward the second or retracted position shown in FIG. 3. The movement of the actuating rod 32 allows the pivot member 14 to pivot clockwise. The release member 42 tends to return to the initial or engaging position under the influence of the biasing force of the spring 47. The pin 16 moves in sliding movement along the side edge of the release member and the pivot member 14 moves clockwise in pivotal movement, until the pin 16 is engaged in the recess 46 as shown in FIG. 3, with the actuating rod 32 in the second or retracted position shown in FIG. 3, the roller 17 is disengaged from the horizontal supporting surface section 38.

Referring to FIG. 2, let us consider the intensities of forces acting on the parts concerned when the actuating rod 32 of the first actuator 20 is in the first or extended position and the release member 42 is in the disengaging position in which the recess 46 is disengaged from the pin 16. With the movable holder 5 being urged by a force $F_1$ exerted by the release spring 18 into abutting engagement with the abutment member 14, the movable member 5 is under the influence of a reaction $F_2$ corresponding to the force $F_1$ exerted by the release spring 18 which is produced by the abutment member 14. However, since the lever arm 9 of the movable holder 5 is connected at one end thereof through the pivot 11 to the bracket 13 secured to the stationary frame 1, a reaction to the reaction $F_2$ is produced about the pivot 11 and absorbed by the stationary frame 1. Thus the reaction $F_2$ exerts no influence on the L-shaped head 33 and the actuating rod 32, and no moment acts on the actuating rod 32. The direction of arrangement of the release spring 18 can be freely selected.

Figure 4:
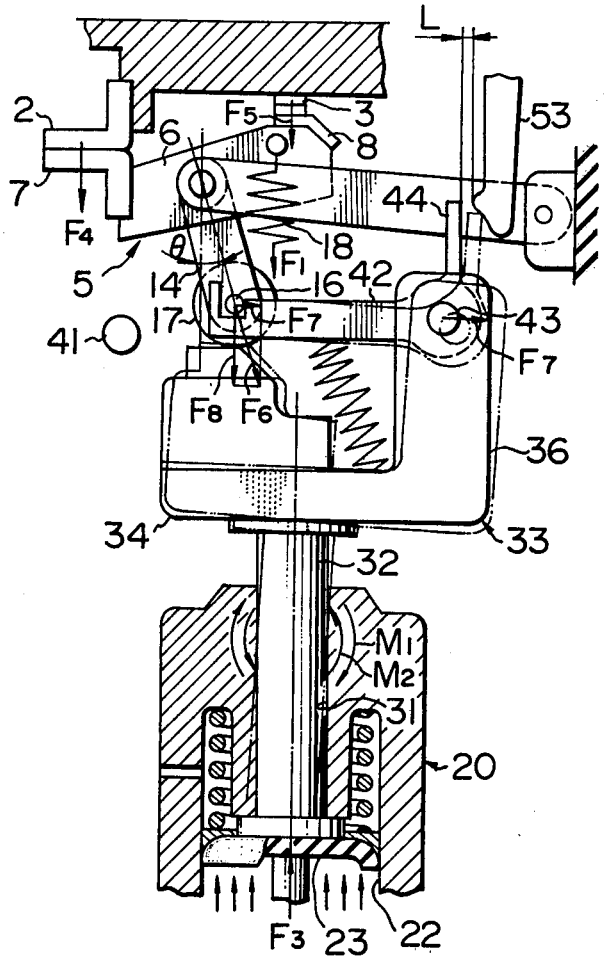
FIG. 4 is a view similar to FIG. 3 but showing the breaker in the OFF position in which the actuating rod is in the second or retracted position and the release member is in the engaging position.

Referring to FIG. 4, let us consider the intensities of forces acting on the parts concerned when the actuating rod 32 of the first actuator 20 is in the first or extended position and the release member 42 is in the engaging position in which the recess 46 is maintained in engagement with the pin 16. The piston 23 is under the influence of a force $F_3$ exerted by the fluid pressure introduced into the cylinder bore 22, and the force $F_3$ is transmitted through the actuating rod 32, L-shaped head 33, supporting block 37, roller 17, pin 16, pivot member 14 and holder body 6 to the movable contact elements 7 and 8, to urge the elements 7 and 8 against the fixed contact elements 2 and 3 respectively. The movable contact elements 7 and 8 are under the influence of reactions $F_4$ and $F_5$ produced by the fixed contact elements 2 and 3 respectively. The roller 17 is urged against the horizontal supporting surface section 38 by a combined force $F_6$ of the reactions $F_4$ and $F_5$ and the force $F_1$ exerted by the release spring 18. Since the pivot member 14 is inclined at an angle $\theta$ with respect to a line parallel to the axis of the actuating rod 32, the release member 42 in engagement with the pin 16 is under the influence of a horizontal component of force $F_7$ of the force $F_6$. Thus $F_7 = F_6 \sin \theta$.

The force $F_7$ exerted on the release member 42 acts on the pivot 43 at which the one end of the release member 42 is connected to the other leg 36 of the L-shaped head 33. The force $F_7$ acting on the pivot 43 causes a moment $M_1$ which is directed clockwise in the figure to be produced on the wall surface of the guide bore 31 for the actuating rod 32. The moment $M_1$ will cause unbalanced wear and fretting corrosion on the wall surface of the guide bore 31 as the breaker is repeatedly turned ON and OFF. Also, the moment $M_1$ brings the release member 42, L-shaped head 33 and actuating rod 32 to inclined positions shown in phantom lines in FIG. 4. This will cause a change to occur in the dimension L of the gap between the projection 44 of the release member 42 and the free end of the lever 53 of the second actuator 50, thereby rendering unstable the operation of the second actuator 50 of turning OFF the breaker.

Referring to FIGS. 5*a* and 5*b*, assume that the horizontally directed force $F_7$ acting on the pivot 43 is borne by the wall surface of the guide bore 31 having a distance $L_1$. The moment $M_1$ is the sum of the product of a reaction $F_{11}$ to the horizontally directed force $F_7$ and a distance $L_2$ between the center of the moment $M_1$ and the point on which the reaction $F_{11}$ acts and the product of a horizontally directed reaction $F_{12}$ and a distance $L_1-L_2$ between the center of the moment $M_1$ and the point on which the reaction $F_{12}$ acts. Thus $$M_1=F_{11}\times L_2+F_{12}\times(L_1-L_2).$$

In order to cope with the moment $M_1$, a position P in which the roller 17 engages the horizontal supporting surface section 38 is displaced, as shown in FIGS. 6*a* and 6*b*, in a direction in which it is spaced apart from the center axis of the actuating rod 32 a distance H away from the pivot 43. A vertical component of force $F_8$ of the force $F_6$ urging the roller 17 against the horizontal supporting surface section 38 and the displacement H of the position P cause a moment $M_2$ directed counterclockwise in the figure or oppositely to the moment $M_1$ to be produced on the wall surface of the guide bore 31 for the actuating rod 32. Assuming that the moment $M_2$ is borne by the wall surface of the guide bore 31 having the length $L_1$, the moment $M_2$ will be the product of a horizontal reaction $F_{13}$ to a vertically directed force $F_8$ and the distance $L_1$. Thus $$M_2=F_8\cdot H=F_{15}\cdot L_1.$$

By maintaining balance between the moment $M_1$ and the moment $M_2$, these two moments will cancel each other out and the mean horizontal force $F_7$ will only act on the wall surface of the guide bore 31 having the distance $L_1$.

The displacement H can be obtained by the following set of equations:

$$F_7\times(L_4+L_2)=F_8\times H$$

$$H=[F_7\times(L_4+L_2)]/F_8.$$

The displacement H obtained by the aforesaid equations has the effect of avoiding unbalanced wear and fretting corrosion which might otherwise be caused on the peripheral surface of the actuating rod 32 and the wall surface of the guide bore 31, thereby enabling the circuit breaker to be positively turned ON and OFF.

While the invention has been described by referring to a preferred embodiment thereof, it is to be understood that the invention is not limited to the specific form of the embodiment and that many changes and modifications may be made therein. For example, the first actuator 32 may be operated electromagnetically.

What we claim is:

1. A high-speed breaker for an electric circuit, comprising:

a pair of opposed contacts;

a movable holder holding thereon one of said pair of contacts, said movable holder being movable toward and away from the other contact between an ON-position where said one contact engages with said the other contact and an OFF-position where said one contact is disengaged from said the other contact;

first actuating means for actuating said movable holder to move the same between said ON-position and said OFF-position, said first actuating means including an actuating rod and a head connected to one end of said actuating rod, said movable holder being engageable with said head, said actuating rod being reciprocally movable axially thereof toward and away from said the other contact between first position where said head engages with said movable holder to move the same to said ON-position and a second position where said movable holder is moved to said OFF-position;

a release member having one end thereof connected to said head, said release member being movable between an engaging position where the other end of said release member engages with said movable holder and a disengaging position where the other end of said release member is disengaged from said movable holder to move the same from said ON-position to said OFF-position;

second actuating means operative in response to overcurrent passing through said electric circuit when said actuating rod of said first actuating means is in said first position, for actuating said release member to cause the same to move from said engaging position to said disengaging position; and the axis of said actuating rod of said first actuating means having an extension located between a position where said movable holder engages with said head and a position where said one end of said release member is connected to said head.

2. A high-speed breaker defined in claim 1 further comprising;

a stationary frame;

an abutment member secured to said stationary frame, said abutment member having abutted thereagainst said movable holder to limit the movement thereof when said movable member is in said OFF-position;

means for biasing said movable holder in the direction where said movable holder is moved from said ON-position to said OFF-position; and said movable holder including a body and a lever having one end thereof connected to said body and the other end connected to said stationary frame.

3. A high-speed breaker defined in claim 2, wherein said movable holder further includes a pivotal member having one end thereof pivotally connected to said holder body and the other free end and having an axis extending at an angle with respect to the axis of said actuating rod of said first actuating means, said the other free end of said pivotal member being engageable with said head, said one end of said lever being pivotally connected to said holder body, said the other end of said lever being pivotally connected to said stationary frame, said one end of said release member being pivotally connected to said head, and said the other end of said release member being pivotally connected to said pivotal member.

4. A high-speed breaker defined in claim 3, wherein said pivotal member has on the other free end thereof a projection, and said release member has in said the other end thereof a recess, said projection being engageable with said recess.

5. A high-speed breaker defined in claim 3 or 4, wherein said pivotal member has rotatably mounted on the other free end thereof a roller engageable with said head.

6. A high-speed breaker defined in claim 4, further comprising a spring having one end thereof connected to said release member and the other end connected to said head for biasing said release member toward said disengaging position, said pivotal member being pivotally moved under the force of said spring when said release member is actuated by said second actuating means into said disengaging position.

7. A high-speed breaker defined in claim 1, 2, 3 or 4, wherein said first actuating means includes a cylinder and a piston slidably received in said cylinder, the other end of said actuating rod being connected to said piston.

8. A high-speed breaker defined in claim 7, wherein said second actuating means includes a solenoid actuator and a lever having one end thereof connected to said solenoid actuator and the other end engageable with said release member.

* * * * *